US009955743B2

(12) United States Patent
Silva

(10) Patent No.: US 9,955,743 B2
(45) Date of Patent: May 1, 2018

(54) STRUCTURAL ARRANGEMENT FOR CLOTHING WAISTBAND

(71) Applicant: Renata Moises Iwamizu Silva, Mirassol (BR)

(72) Inventor: Renata Moises Iwamizu Silva, Mirassol (BR)

( * ) Notice: Subject to any disclaimer, the term of this patent is extended or adjusted under 35 U.S.C. 154(b) by 116 days.

(21) Appl. No.: 14/402,744

(22) PCT Filed: Mar. 28, 2013

(86) PCT No.: PCT/BR2013/000099
§ 371 (c)(1),
(2) Date: Nov. 21, 2014

(87) PCT Pub. No.: WO2013/173892
PCT Pub. Date: Nov. 28, 2013

(65) Prior Publication Data

US 2015/0106994 A1 Apr. 23, 2015

(30) Foreign Application Priority Data

May 24, 2012 (BR) ..... 202012012439

(51) Int. Cl.
*A41F 9/00* (2006.01)
*A41D 1/14* (2006.01)
(Continued)

(52) U.S. Cl.
CPC ..... *A41F 9/00* (2013.01); *A41D 1/06* (2013.01); *A41D 1/14* (2013.01); *A41D 1/22* (2013.01); *A41F 9/02* (2013.01)

(58) Field of Classification Search
CPC .... A41D 1/06; A41D 1/14; A41D 1/22; A41F 9/00; A41F 9/02
See application file for complete search history.

(56) References Cited

U.S. PATENT DOCUMENTS 993,886 A * 5/1911 Schmitz ..... A41F 9/02 2/237
2,024,922 A * 12/1935 Hendel ..... A41F 9/02 2/237
(Continued)

FOREIGN PATENT DOCUMENTS

BR PI72361 3/1955
BR MU77629 2/1961
(Continued)

OTHER PUBLICATIONS

International Search Report in International Patent Application No. PCT/BR2013/000099, 3pgs.

*Primary Examiner* — Anna Kinsaul
(74) *Attorney, Agent, or Firm* — Leason Ellis LLP

(57) ABSTRACT

STRUCTURAL ARRANGEMENT FOR CLOTHING WAISTBAND developed to allow a usual masculine or feminine clothing (1), either pants, Bermuda shorts, skirt, dress or the like, to include an elastic arrangement in an interrupted portion (2) dividing the waistband in two segments, a front segment (3*a*) and a back segment (3*b*), in such a way that this elastic arrangement on both sides of the clothing, left and right, is sufficient to allow the waistband to be automatically adjusted increasing or decreasing the clothing by two or more sizes and rendering the clothing more comfortable for the use, in particular when sitting down and standing up performing other movements requiring bending at the waist.

8 Claims, 4 Drawing Sheets

(51) Int. Cl.

| | |
|---|---|
| ***A41D 1/22*** | (2006.01) |
| ***A41D 1/06*** | (2006.01) |
| ***A41F 9/02*** | (2006.01) |

(56) References Cited

U.S. PATENT DOCUMENTS

| | | | | | |
|---|---|---|---|---|---|
| 3,098,238 | A * | 7/1963 | Diamond | ..... | A41F 9/02 2/237 |
| 5,544,366 | A | 8/1996 | Kato | | |
| 2009/0126079 | A1* | 5/2009 | Kato | ..... | A41F 9/02 2/237 |

FOREIGN PATENT DOCUMENTS

| | | | |
|---|---|---|---|
| BR | MU7500699 | A | 5/1997 |
| BR | PI0801535-0 | A2 | 11/2009 |
| BR | PI0614837-9 | A2 | 4/2011 |
| EP | 1245164 | A2 | 10/2002 |
| FR | 2692113 | A1 | 12/1993 |
| GB | 886114 | A | 1/1962 |
| GB | 2448803 | A | 10/2008 |
| JP | 2011-168951 | A | 9/2011 |
| MX | PA02010526 | A | 4/2004 |
| MX | 2007014620 | A | 5/2009 |
| MX | 2012002784 | A | 11/2012 |

* cited by examiner

STRUCTURAL ARRANGEMENT FOR CLOTHING WAISTBAND

TECHNICAL FIELD

More particularly, the present Utility Model relates to technical and functional improvements especially developed to be used in the waistband for clothing in general, either formal or not, including jeans and others, considering the characterization of elastic means for the waist area to self-adjust to two or more larger sizes, reaching 12 cm in some styles, and rendering the clothing more comfortable for the user. That construction offers flexibility while the product is being worn, which is important mainly when sitting down and standing up or performing other movements which causes natural waist area expansion, being distinctive for not causing any prejudice to the product aesthetics.

STATE OF THE ART

Currently there is a significant variety of clothes designed with elastics around the waist, in some cases to eliminate belt wearing, while in other cases they are designed so as the waistband may expand and contract by means of elastic arrangement and render the clothing more comfortable for the user, as the following documents, for example, teach:

BRPI72361—Mar. 23, 1954
IMPROVED PANTS WAISTBANDS
BRPI64158—Apr. 18, 1958
IMPROVED ELASTIC WAISTBAND PANTS
FR2692113A1—Jun. 10, 1992
Article d'habillement à ceinture extensible
BRMU77629—Feb. 1, 1995
ELASTIC DEVICE TO BELT PANTS
BRMU7500699—Apr. 25, 1995
FLEXIBLE DEVICE APPLIED TO WAISTBAND
BRPI0614837—Aug. 23, 2006
DISPOSABLE PULLING CLOTH WITH RUCHING WAISTBAND
BRPI0801535—Mar. 27, 2008
CONSTRUCTIVE ARRANGEMENT FOR WAISTBAND ADJUSTMENT

DISADVANTAGES OF THE CONVENTIONAL MODELS

There is no doubt that the known devices define elastic means for the waist area in pants to be automatically self-adjusting and means for increasing and decreasing its size during body movements, rendering the clothing more comfortable for the user, however, with time, it has been observed that the constructive details to reach such objectives negatively interfere in the cloth design, not only for being apparent, but also due to the fact that elastic means are positioned at points that make it impossible to hide or be covered by the waistband constructive details.

It also happens that, in conventional styles, the desired effect from elastics is not efficiently reached, as the visible wrinkling the elastic causes prejudice to the product aesthetic, limiting its use.

OBJECTIVES

A new structural arrangement especially developed considering the concretization of elastic means and internal adaptations of pockets that integrate to and compose continuances of the pants waistband itself, allowing all details to be completely embedded in and do not interfere with the clothing design, and also, that construction allows the elastics to be completely free so that their movements are the most accurate, broadest and cause no deformation in the pants.

DESCRIPTION OF THE DRAWINGS

To better understand the present Utility Model, a detailed description of it is made below, with reference to the enclosed drawings.

Figure 1:
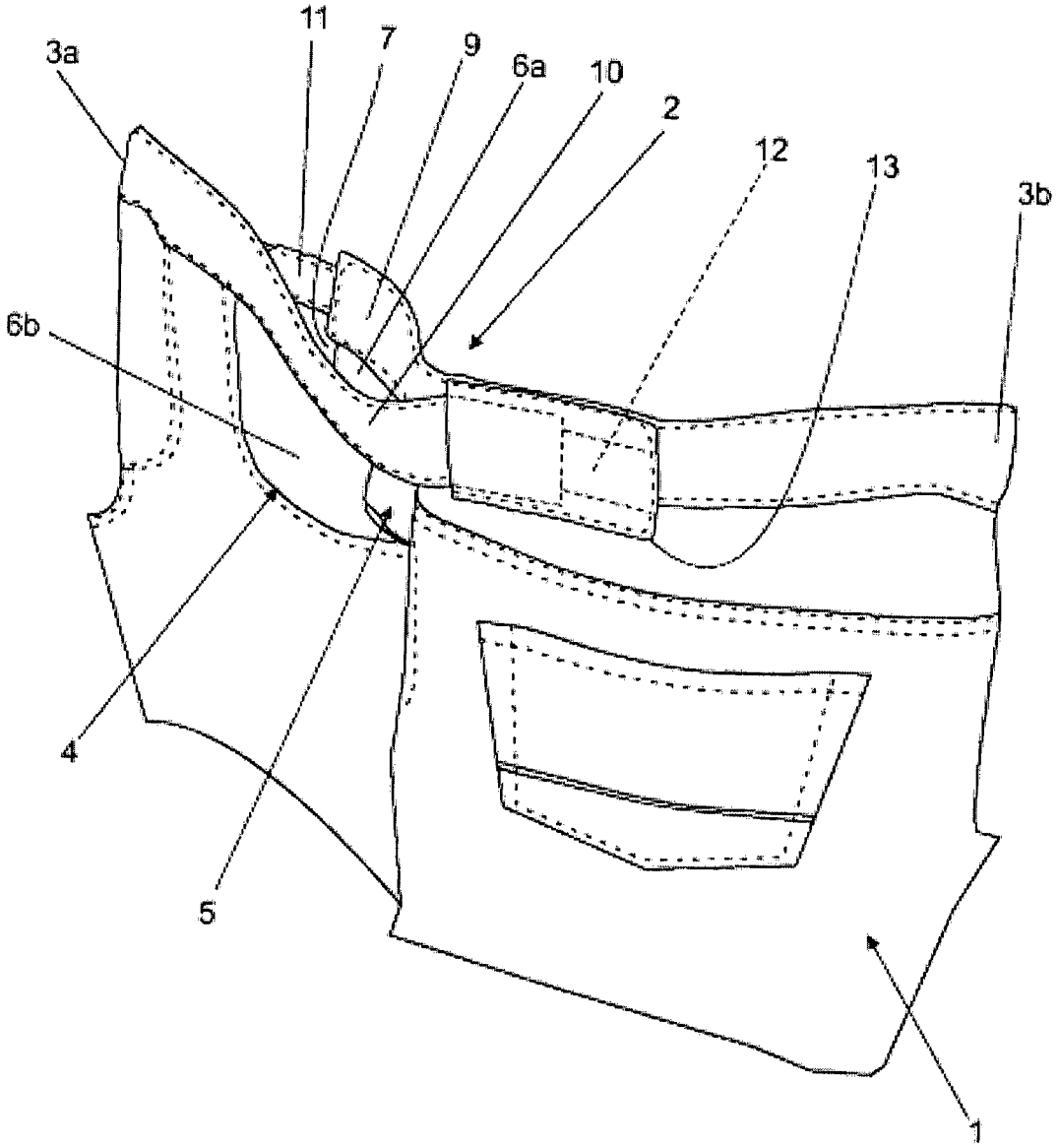
FIG. 1 shows a perspective view of an enlarged detail showing the outer side of part of a piece of clothing in which waistband includes the present structural arrangement.
Figure 2:
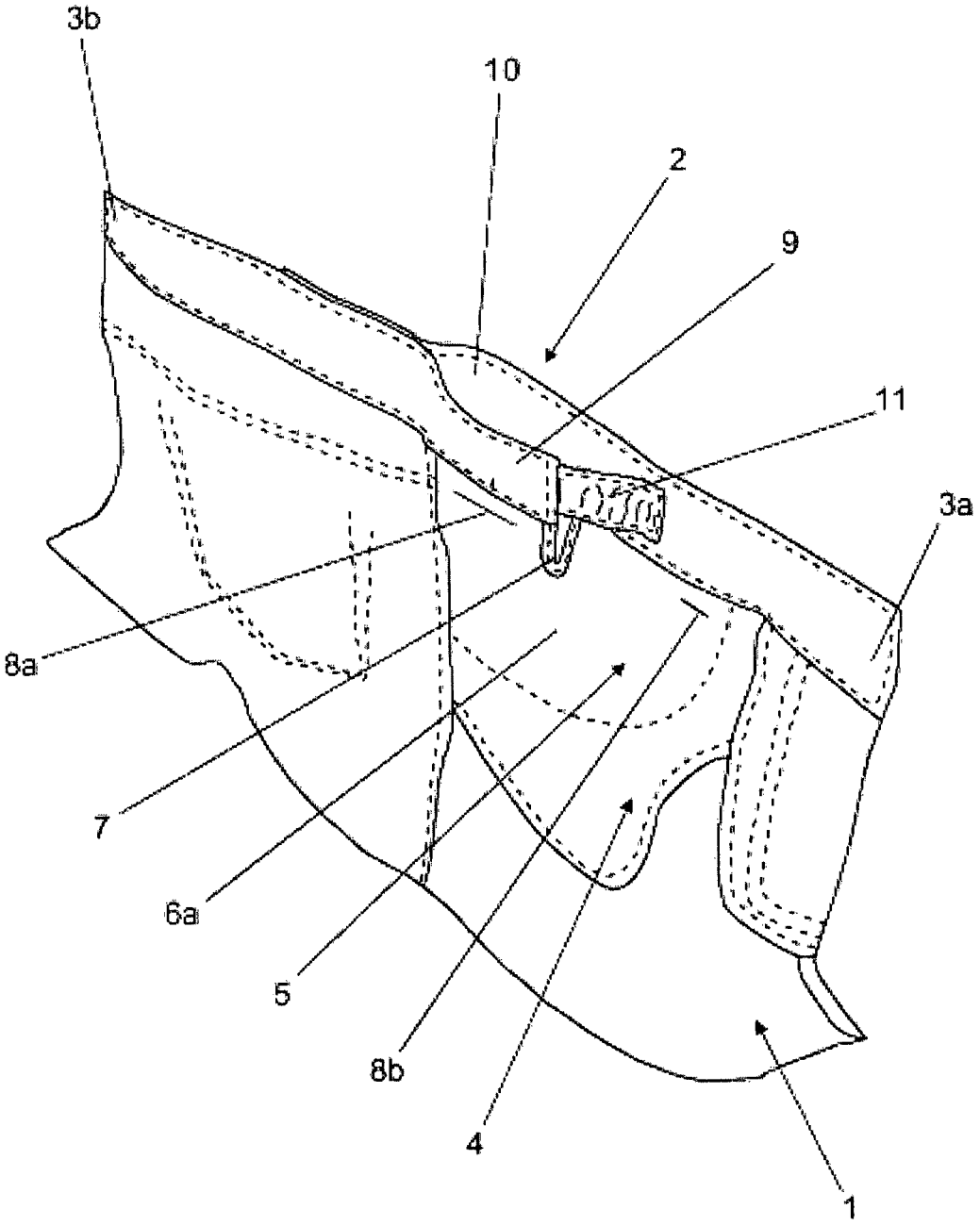
FIG. 2 shows another perspective view practically equal to the previous figure, however, showing the inside of the piece of clothing.
Figure 3:
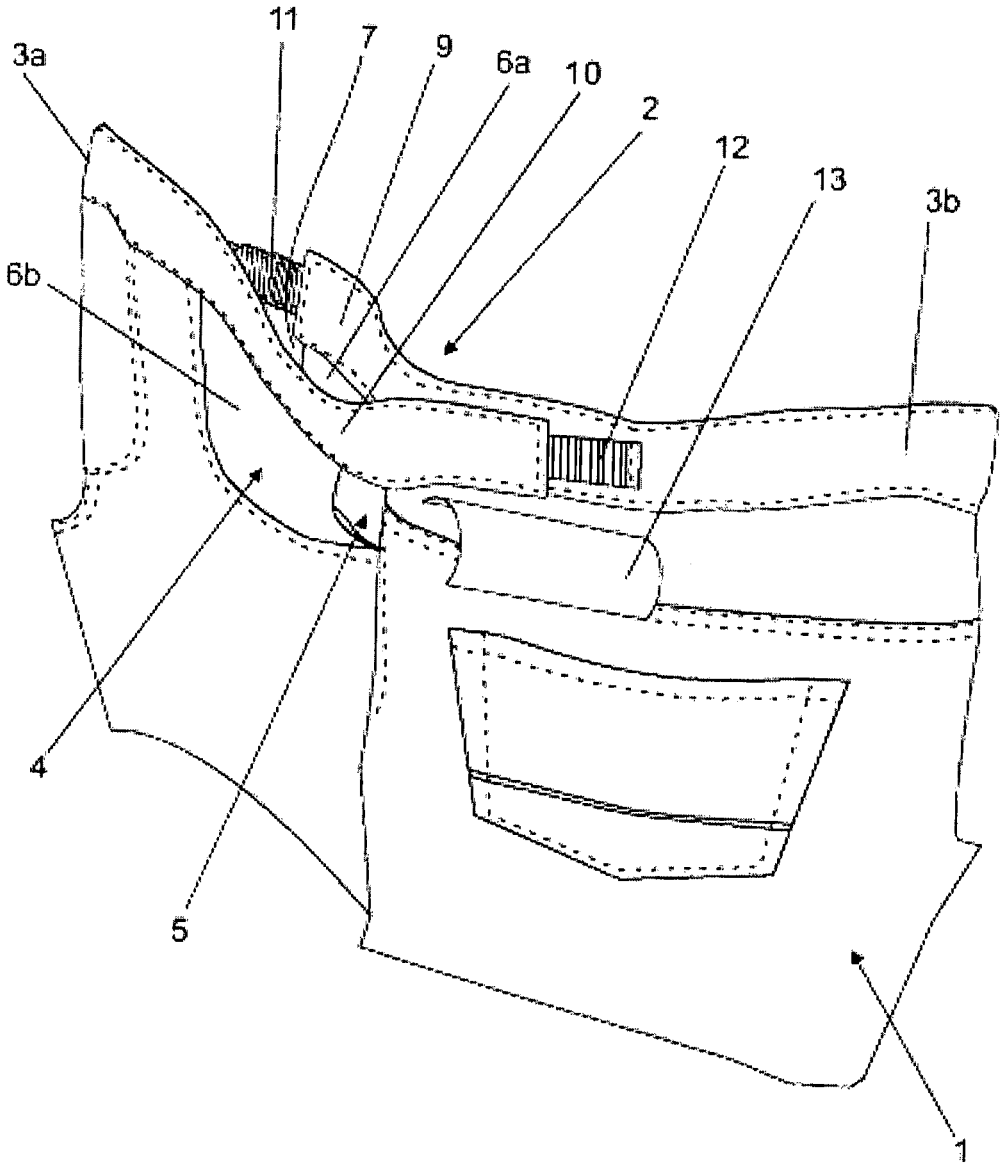
FIG. 3 illustrates a last perspective equal to FIG. 1, however, having one part of the piece of clothing removed, in order to illustrate the fixation of one of the elastics.

According to those illustrations and in their details, more particularly FIGS. 1, 2 and 3, the present Utility Model, STRUCTURAL ARRANGEMENT FOR CLOTHING WAISTBAND, presents, as the predominant characteristic, the fact of a usual masculine or feminine clothing (1), either pants, Bermuda shorts, skirt, dress or the like, includes elastic means on both sides, left and right, which is sufficient to allow the waistband to be automatically adjusted, increasing or decreasing the clothing by two or more sizes and rendering the clothing more comfortable for the use, in particular when sitting down and standing up or performing other movements requiring bending at the waist.

The model in question is characterized in that, on each side of the usual clothing (1), there is an elastic arrangement in an interrupted portion (2) dividing the waistband in two segments, a front segment (3*a*) and a back segment (3*b*), both combined with two pockets on each side (4) and (5); with the second one behind the first one and composing the inner pocket, which, on its turn, has on its inner wall (6*a*) an upper "V" cut (7) dividing the upper edge of said inner wall in two horizontal portions (8*a*) and (8*b*), to which the interrupted portion (2) parts are fixed, which, on its turn, is defined by two overlapping extensions of the waistband segments (3*a* and 3*b*), an inner one (9) and an outer one (10), wherein the first one has its lower edge fixed on the first horizontal half of portion or horizontal portion (8*a*) of the pocket (5), while the other segment is equally fixed on the other half composing the horizontal portion (8*b*); however, in this case, the other anterior wall (6*b*) upper edge of said pocket (5) is also fixed, which wall (6*b*) covers or embeds the "V" cut (7), and also, the extension (9) has its free end facing forward and interconnected with the corresponding end of an elastic (11) stretching on the same alignment, whose other end is fixed to the inner side of the front waistband segment (3*a*), which construction repeats as such on the other outer extension (10) whose free end is facing backwards and whose elastic (12) is equally fixed on the outer side of said back waistband segment (3*b*), and at that point, said elastic (12) and the corresponding end of the outer extension (10) are embedded and move within a portion of fabric as a little pocket (13).

Figure 4:
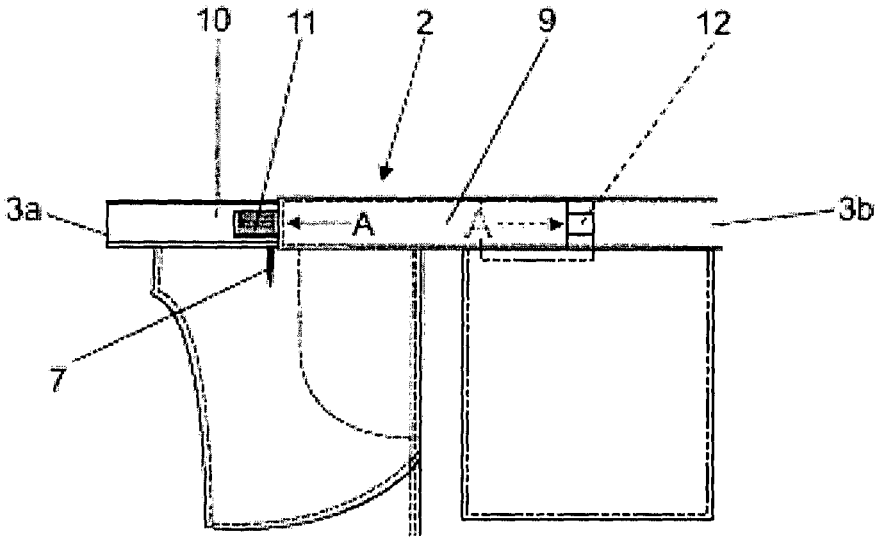
FIG. 4 is a plan side view showing part of a piece of clothing, in which the elastics system is at a resting position and, in this case, the waistband defines the clothing size.
Figure 5:
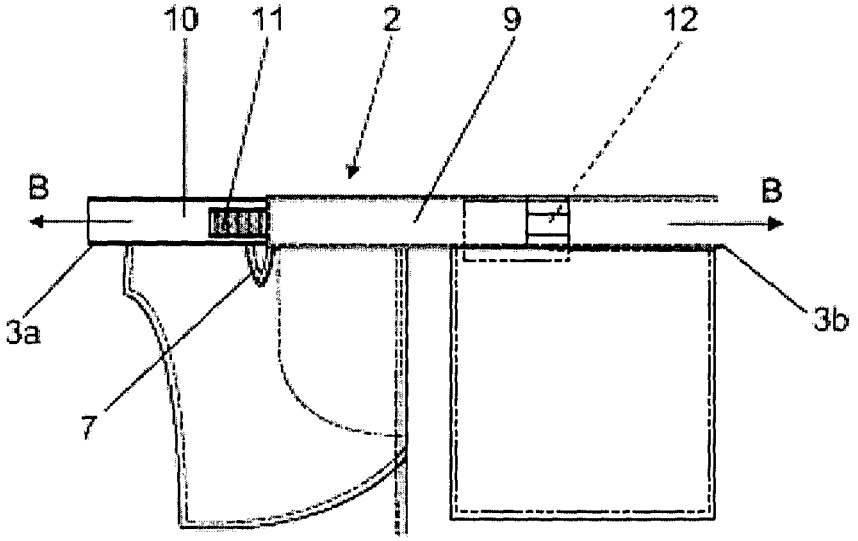
FIG. 5 shows a view equal to the previous one, however, in this case, the elastics are stretched, evidencing the increased size.

As shown in FIG. 4, the action of the elastics (11-12) concurs to produce two different effects on the waistband segments (3*a* and 3*b*). The first effect is traction (arrows A). In that effect the overlapped extensions are moved by traction in opposite directions (arrows A), and consequently, said overlapped extensions (9-10) slide one over the other as to close the "V" cut (7) and reduce or "fasten" the waist up to the size defined by the clothing (1), keeping it tight to the user's body, such as when standing or walking normally. However, that elastics action condition (11-12) changes completely when the user sits down or goes to a similar posture requiring loosening of the waist area. In that condition, the elastics (11-12) stretch to open the "V" cut (7), as shown in FIG. 5, because the user's body provokes forces that overcome those established by said elastics (11-12). The user's waist area expansion is represented by arrows B, and in this case, it is observed that such expansion is applied to the waistband segments (3*a* and 3*b*), consequently, both elastics (11-12) stretch and the extensions (9-10) slide again to increase the size of the clothing. That increase is automatic and follows the user's waist area expansion, keeping the clothing (1) perfectly adjusted, and also does not cause those deformations in the waistband and its adjacent parts, keeping the pants in their correct shape.

In any of the conditions above, A or B, the waistband (3*a* and 3*b*) increases and decreases practically without being noticed, as all structural arrangements details are embedded, not interfering in the design of the clothing and not adding any undesired aspect.

The moving and increasing of the piece measures is defined by the size and wider angle of the "V" cut (7) made in the liner or inner wall (6*a*) of the pocket (5). In that condition, said "V" cut (7) may be changed in some clothes styles and allow a wider range of measures for the piece.

As it can be noticed, after what has been exposed and illustrated, the object in question, STRUCTURAL ARRANGEMENT FOR CLOTHING WAISTBAND, perfectly fits the criteria defining the Utility Model, as, in addition to being susceptible to industrial application, it also provides a new form or arrangement, involving inventive act, resulting in functional improvement in use and manufacturing.

The invention claimed is:

1. A clothing waistband of a garment comprising:

at least one interrupted portion dividing the waistband into a front segment and a back segment, wherein said front segment and back segment can move relative to one another expanding or contracting the waistband;

wherein the garment, with which the waistband is associated, comprises first and second pockets, wherein the second pocket is behind the first pocket toward the interior of the garment thereby constituting an inner pocket having an inner wall;

an upper "V" cut disposed in the inner wall, wherein the upper "V" cut divides a portion of the inner wall into a first horizontal portion and a second horizontal portion, the first horizontal portion being adjacent to a second side of the upper "V" cut;

wherein the at least one interrupted portion includes overlapping inner and outer segments, wherein a lower edge of the inner segment is associated with the first horizontal portion of the inner wall on one side of the upper "V" cut, and the lower edge of the outer segment is associated with the second horizontal portion of the inner wall on another side of the upper "V" cut, and wherein said outer segment is also associated with a portion of an anterior wall;

wherein the inner segment has a first end connected to a first end of a first elastic component, and wherein the first elastic component has a second end connected to the front segment;

wherein the outer segment has a first end connected to a first end of a second elastic component, and wherein the second elastic component has a second end connected to the back segment; and wherein the first elastic component and the second elastic component do not overlap one another.

2. The clothing waistband of claim 1, wherein the inner wall is an inner wall of at least one pocket of a garment including the clothing waistband.

3. The clothing waistband according to claim 2, wherein the overlapping inner and outer segments, are associated with the upper edges of the inner wall of the at least one pocket.

4. The clothing waistband according to claim 1, wherein the interrupted portion is associated with a garment chosen from pants, Bermuda shorts, a skirt, and a dress.

5. The clothing waistband according to claim 1, further comprising first and second interrupted portions, wherein the first and second interrupted portions are present substantially opposite one another in the garment.

6. The clothing waistband according to claim 1, wherein the anterior wall is a wall of the said second pocket.

7. The clothing waistband according to claim 1, wherein the anterior wall covers or embeds the upper "V" cut.

8. The clothing waistband according to claim 1, characterized in that the second elastic component and the first end of the outer segment are disposed within a pocket formed by a portion of fabric that is coupled to the back segment of the interrupted portion.

* * * * *